US009840961B2

(12) United States Patent
Craft et al.

(10) Patent No.: US 9,840,961 B2
(45) Date of Patent: Dec. 12, 2017

(54) CYLINDER HEAD OF AN INTERNAL COMBUSTION ENGINE

(71) Applicant: Ford Global Technologies, LLC, Dearborn, MI (US)

(72) Inventors: Justin Craft, Royal Oak, MI (US); John Christopher Riegger, Ann Arbor, MI (US); Philip Damian Cierpial, Grosse Pointe Park, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 67 days.

(21) Appl. No.: 15/138,391

(22) Filed: Apr. 26, 2016

(65) Prior Publication Data

US 2017/0306831 A1 Oct. 26, 2017

(51) Int. Cl.

| | |
|---|---|
| ***F01P 3/02*** | (2006.01) |
| ***F01P 3/12*** | (2006.01) |
| ***F01P 3/16*** | (2006.01) |
| ***F01P 5/12*** | (2006.01) |
| ***F01P 3/14*** | (2006.01) |

(52) U.S. Cl.

CPC ..... *F01P 3/02* (2013.01); *F01P 3/14* (2013.01); *F01P 3/16* (2013.01); *F01P 5/12* (2013.01); *F01P 2003/024* (2013.01)

(58) Field of Classification Search

CPC ..... F01P 3/02; F01P 3/12; F01P 3/14; F01P 3/16; F01P 5/12

See application file for complete search history.

(56) References Cited

U.S. PATENT DOCUMENTS

| | | | | |
|---|---|---|---|---|
| 6,158,400 | A | 12/2000 | Collie et al. | |
| 6,390,032 | B1 | 5/2002 | Van Klompenburg | |
| 8,776,735 | B2 | 7/2014 | Kosugi et al. | |
| 2012/0312257 | A1* | 12/2012 | Beyer | F01P 11/0285 123/41.82 R |
| 2015/0292389 | A1 | 10/2015 | Clark et al. | |

FOREIGN PATENT DOCUMENTS

DE 102013221231 A1 4/2014

* cited by examiner

*Primary Examiner* — Jacob Amick

(74) *Attorney, Agent, or Firm* — Brooks Kushman P.C.; Greg Brown

(57) ABSTRACT

An engine is provided with a cylinder head defining a coolant jacket therein that is formed from a series of passages interconnected by a series of curved junctions to direct coolant about spark plugs, exhaust valves, and an integrated exhaust manifold in the head. The cooling jacket has a first longitudinal passage with an annular section about a spark plug, a second longitudinal passage with an annular section about an exhaust valve, and a third passage surrounding an integrated exhaust manifold and fluidly connecting the first and second passages. The first passage has a continuously decreasing area and the second passage has a continuously increasing area in a direction of coolant flow.

19 Claims, 7 Drawing Sheets

CYLINDER HEAD OF AN INTERNAL COMBUSTION ENGINE

TECHNICAL FIELD

Various embodiments relate to a cylinder head of an internal combustion engine and cooling thereof.

BACKGROUND

Internal combustion engines may require cooling during engine operation based on heat produced by the in-cylinder combustion process. The engine may be formed from a cylinder block and a cylinder head that cooperate to define a cylinder. The engine block and cylinder head may have various passages formed therein to provide coolant flow through the engine to control the temperature during operation.

SUMMARY

In an embodiment, a cylinder head is provided with a member defining a cooling jacket having a first longitudinal passage with an annular section about a spark plug, a second longitudinal passage with an annular section about an exhaust valve, and a third passage surrounding an integrated exhaust manifold and fluidly connecting the first and second passages. The first passage has a continuously decreasing area and the second passage has a continuously increasing area in a direction of coolant flow.

In another embodiment, an engine is provided with a cylinder head having a deck face to mate with a corresponding face of a cylinder block. The head defines a coolant jacket therein that is formed from a series of passages interconnected by a series of curved junctions to direct coolant about spark plugs, exhaust valves, and an integrated exhaust manifold in the head. Each passage in the cooling jacket has a length that is greater than an average effective diameter of the passage.

In yet another embodiment, an engine component has a cylinder head defining a cooling jacket. The cooling jacket has a first passage extending longitudinally from a first end region to a second end region of the head, with the first passage having a continuously decreasing cross-sectional area towards the second end region and in a direction of coolant flow therethrough. The first passage having a series of annular regions, each annular region surrounding a recess sized to receive a spark plug. The cooling jacket has a second passage extending longitudinally from the second end region to the first end region of the head, with the second passage having a continuously increasing cross-sectional area towards the first end region and in a direction of coolant flow therethrough. The second passage receives coolant from the first passage. The second passage has a series of pairs of annular regions, with each pair of annular regions surrounding a pair of recesses sized to receive a pair of exhaust valves.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
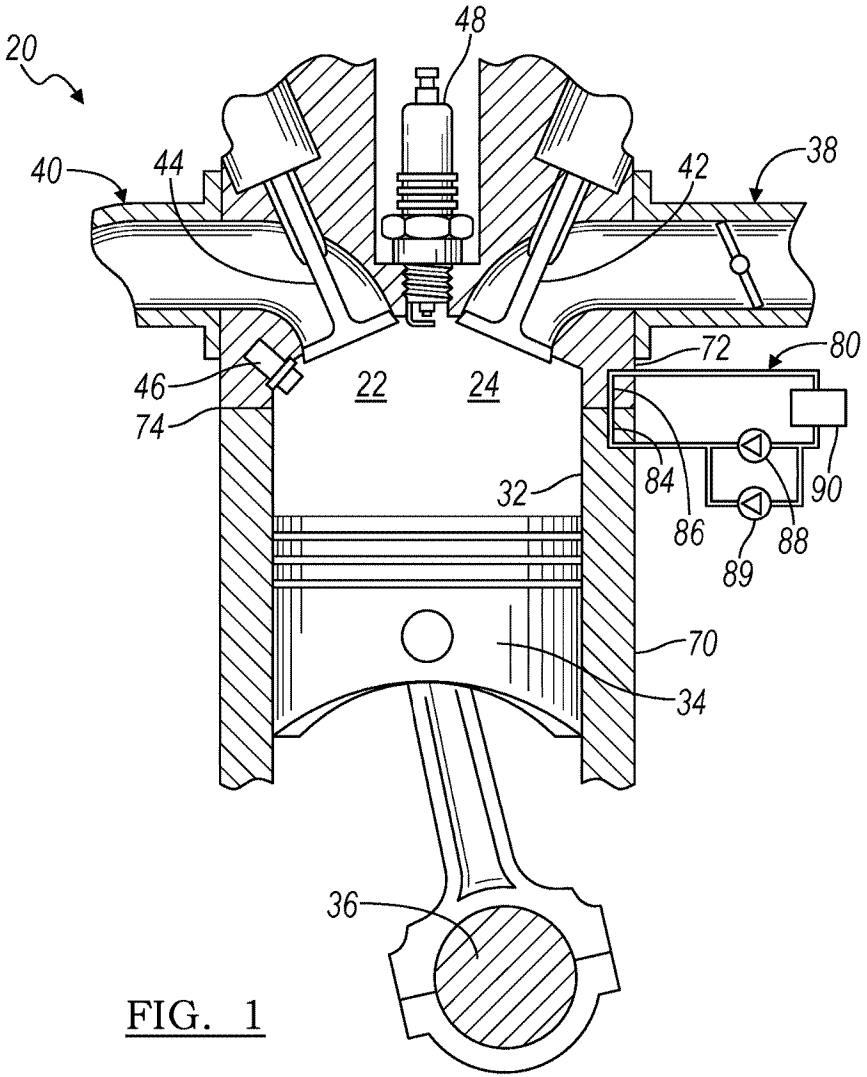
FIG. 1 illustrates a schematic of an internal combustion engine capable of implementing the disclosed embodiments.

FIG. 1 illustrates a schematic of an internal combustion engine 20. The engine 20 has a plurality of cylinders 22, and one cylinder is illustrated. The engine 20 may have any number of cylinders, and the cylinders may be arranged in various configurations. The engine 20 has a combustion chamber 24 associated with each cylinder 22. The cylinder 22 is formed by cylinder walls 32 and piston 34. The piston 34 is connected to a crankshaft 36. The combustion chamber 24 is in fluid communication with the intake manifold 38 and the exhaust manifold 40. An intake valve 42 controls flow from the intake manifold 38 into the combustion chamber 24. An exhaust valve 44 controls flow from the combustion chamber 24 to the exhaust system(s) 40 or exhaust manifold. The intake and exhaust valves 42, 44 may be operated in various ways as is known in the art to control the engine operation.

A fuel injector 46 delivers fuel from a fuel system directly into the combustion chamber 24 such that the engine is a direct injection engine. A low pressure or high pressure fuel injection system may be used with the engine 20, or a port injection system may be used in other examples. An ignition system includes a spark plug 48 that is controlled to provide energy in the form of a spark to ignite a fuel air mixture in the combustion chamber 24. The spark plug 48 may be positioned overhead or to one side of the cylinder 22. In other embodiments, other fuel delivery systems and ignition systems or techniques may be used, including compression ignition.

The engine 20 includes a controller and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust system 40, an engine coolant temperature sensor, an accelerator pedal position sensor, an engine manifold pressure (MAP) sensor, an engine position sensor for crankshaft position, an air mass sensor in the intake manifold 38, a throttle position sensor, an exhaust gas temperature sensor in the exhaust system 40, and the like.

In some embodiments, the engine 20 is used as the sole prime mover in a vehicle, such as a conventional vehicle, or a stop-start vehicle. In other embodiments, the engine may be used in a hybrid vehicle where an additional prime mover, such as an electric machine, is available to provide additional power to propel the vehicle.

Each cylinder 22 may operate under a four-stroke cycle including an intake stroke, a compression stroke, an ignition stroke, and an exhaust stroke. In other embodiments, the engine may operate with a two stroke cycle. During the intake stroke, the intake valve 42 opens and the exhaust valve 44 closes while the piston 34 moves from the top of the cylinder 22 to the bottom of the cylinder 22 to introduce air from the intake manifold to the combustion chamber. The piston 34 position at the top of the cylinder 22 is generally known as top dead center (TDC). The piston 34 position at the bottom of the cylinder is generally known as bottom dead center (BDC).

During the compression stroke, the intake and exhaust valves 42, 44 are closed. The piston 34 moves from the bottom towards the top of the cylinder 22 to compress the air within the combustion chamber 24.

Fuel is introduced into the combustion chamber 24 and ignited. In the engine 20 shown, the fuel is injected into the chamber 24 and is then ignited using spark plug 48. In other examples, the fuel may be ignited using compression ignition.

During the expansion stroke, the ignited fuel air mixture in the combustion chamber 24 expands, thereby causing the piston 34 to move from the top of the cylinder 22 to the bottom of the cylinder 22. The movement of the piston 34 causes a corresponding movement in crankshaft 36 and provides for a mechanical torque output from the engine 20.

During the exhaust stroke, the intake valve 42 remains closed, and the exhaust valve 44 opens. The piston 34 moves from the bottom of the cylinder to the top of the cylinder 22 to remove the exhaust gases and combustion products from the combustion chamber 24 by reducing the volume of the chamber 24. The exhaust gases flow from the combustion cylinder 22 to the exhaust system 40 as described below and to an after-treatment system such as a catalytic converter.

The intake and exhaust valve 42, 44 positions and timing, as well as the fuel injection timing and ignition timing may be varied for the various engine strokes.

The engine 20 has a cylinder block 70 and a cylinder head 72 that cooperate with one another to form the combustion chambers 24. A head gasket (not shown) may be positioned between the block 70 and the head 72 to seal the chamber 24. The cylinder block 70 has a block deck face that corresponds with and mates with a head deck face of the cylinder head 72 along part line 74.

The engine 20 includes a fluid system 80. In one example, the fluid system 80 is a cooling system 80 to remove heat from the engine 20. In another example, the fluid system 80 is a lubrication system 80 to lubricate engine components.

For a cooling system 80, the amount of heat removed from the engine 20 may be controlled by a cooling system controller, the engine controller, one or more thermostats, and the like. The system 80 may be integrated into the engine 20 as one or more cooling jackets that are cast, machined, or other formed in the engine. The system 80 has one or more cooling circuits that may contain an ethylene glycol/water antifreeze mixture, another water-based fluid, or another coolant as the working fluid. In one example, the cooling circuit has a first cooling jacket 84 in the cylinder block 70 and a second cooling jacket 86 in the cylinder head 72 with the jackets 84, 86 in fluid communication with each other. In another example, jacket 86 is independently controlled and is separate from jacket 84. Coolant in the cooling circuit 80 and jackets 84, 86 flows from an area of high pressure towards an area of lower pressure.

The fluid system 80 has one or more pumps 88. In a cooling system 80, the pump 88 provides fluid in the circuit to fluid passages in the cylinder block 70, and then to the head 72. The cooling system 80 may also include valves or thermostats (not shown) to control the flow or pressure of coolant, or direct coolant within the system 80. The cooling passages in the cylinder block 70 may be adjacent to one or more of the combustion chambers 24 and cylinders 22. Similarly, the cooling passages in the cylinder head 72 may be adjacent to one or more of the combustion chambers 24 and the exhaust ports for the exhaust valves 44. Fluid flows from the cylinder head 72 and out of the engine 20 to a heat exchanger 90 such as a radiator where heat is transferred from the coolant to the environment.

Figure 2:
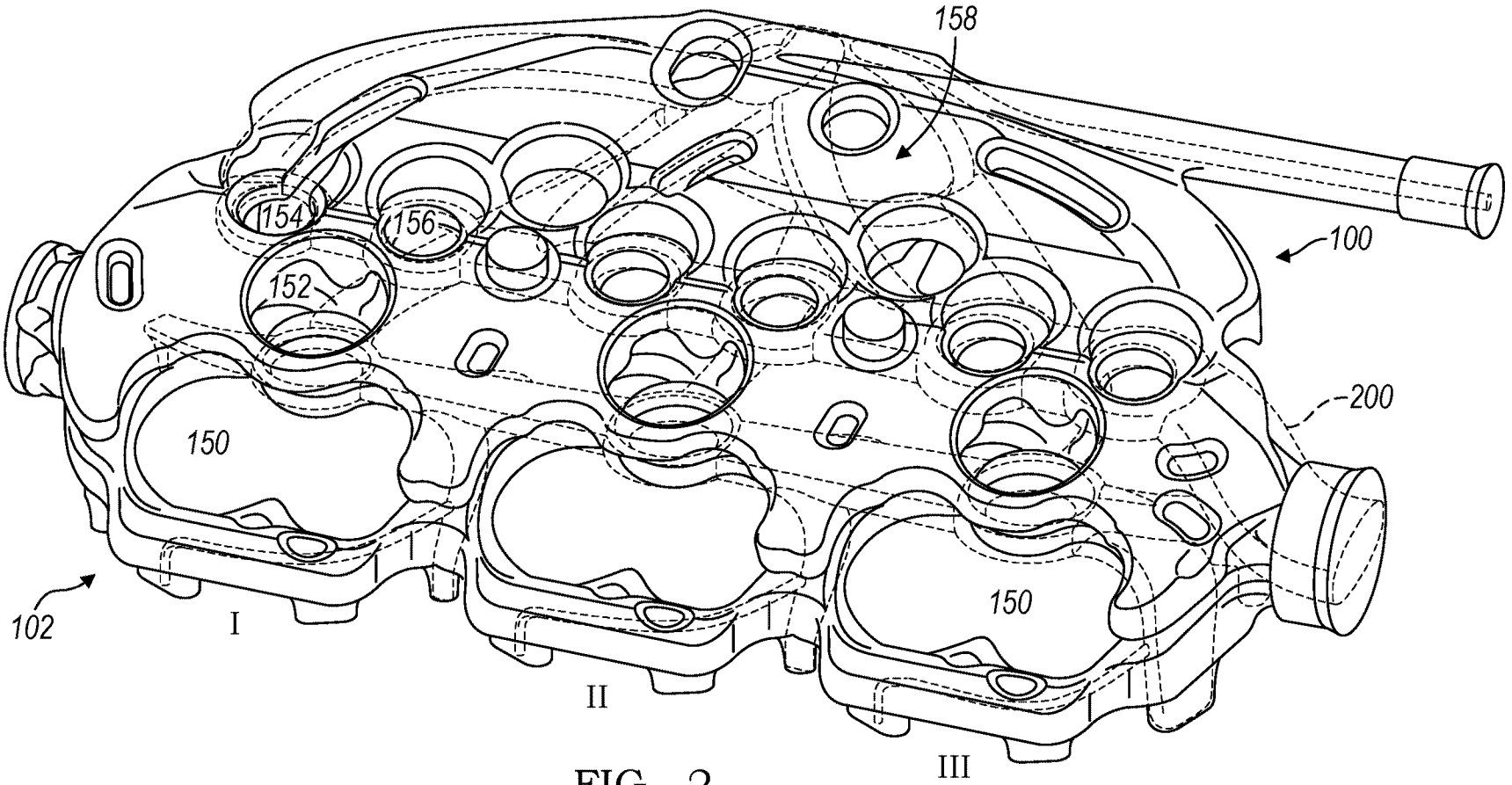
FIG. 2 illustrates a perspective view of cores for a conventional cooling jacket system and a core for a cooling jacket according to an embodiment.

FIG. 2 illustrates a perspective view of cores used to form a conventional upper cooling jacket 100 and lower cooling jacket 102 for a cylinder head. The conventional jackets 100, 102 may be generally designed to occupy a large portion of the cylinder head to distribute coolant therethrough in an open jacket configuration. A cooling jacket 200 according to the present disclosure is also illustrated in FIG. 2 for comparison, and is shown in broken lines. The cylinder head may be the cylinder head 72 for use with the engine 20 as described above with respect to FIG. 1. The jackets 100, 102, 200 are illustrated for use with a cylinder head for a three cylinder, in-line engine with an integrated exhaust manifold in the cylinder head and four overhead valves per cylinder, e.g. two intake and two exhaust valves per cylinder; however, the cooling jacket 200 may be configured for use with other cylinder heads and engine configurations according to the present disclosure. The cooling jackets 100, 102, 200 are illustrated as cores for forming the cooling passages for each jacket within the cylinder head. Each core represents a negative view of corresponding passages within the head, and may represent the shape of a sand core or lost core used in a casting process for the head.

The cylinder head mates with a corresponding cylinder block to provide three cylinders, generally positioned and indicated as I, II, III in FIG. 2, and the cylinder head may receive coolant from the cylinder block, as shown in FIG. 1. The head provides support for two intake valves for each cylinder that are positioned in region 150 of FIG. 2 for the associated cylinder. A spark plug for each cylinder is positioned in region 152. First and second exhaust valves for each cylinder are positioned in regions 154, 156. The head has an integrated exhaust manifold which passages through region 158 which is adjacent to an exhaust face of the head. An exhaust manifold 40 attaches to the exhaust face of the head, as shown in FIG. 1. An integrated exhaust manifold provides for exhaust passages or runners formed within the head from the exhaust valves and ports to an exhaust face of the cylinder head where an exhaust manifold, turbocharger, or the like connects.

The cooling jacket 200 provides for equivalent cooling of the cylinder head as compared to the conventional jackets 100, 102, but occupies a much smaller volume of the cylinder head. As the volume of the cooling jacket 200 is lower than the conventional jackets 100, 102, the same flow velocity and heat transfer rates may be provided in the cooling jacket 200 using a smaller pump 88. Similarly, as the volume of the cooling jacket 200 is lower than the conventional jackets 100, 102, a higher flow velocity and heat transfer rates may be provided using the same pump 88. The cooling jacket 200 only directs coolant to regions of the cylinder head that are hot during engine operation and require cooling. The cooling jacket 200 does not direct coolant to regions of the engine that rise in temperature during engine operation but remain below a specified threshold or below the melting point of the cylinder head material at a maximum engine load and high ambient temperature.

The cooling passages of the cooling jacket 200 may be formed with complex shapes and structures, as described herein, and are formed at the time the component or head is cast, molded, or the like as a net shape that generally does not require further machining or processing. The component or cylinder head may be formed from a metal, for example aluminum or an aluminum alloy in a high pressure, near net or net die casting process. In one example, the cooling jacket is formed from or includes a lost core material such as a salt core, a sand core, a glass core, a foam core, or another lost core material as appropriate.

The cooling jacket 200 is provided with shapes to minimize flow disturbances. For example, fluid junctions are provided as y-shaped junctions. Fluid passages may have a continuously increasing or decreasing tapering cross section. Turns made by the fluid passages in the cooling jacket are made using a smooth curved structure, and may have no greater than a ninety degree bend, and may include a radius of curvature that is several times larger than a diameter of the passage. The cooling jacket 200 may have slight curves or bends to better package the passages within the constraints of the component.

The fluid passages in the cooling jacket 200 may have circular cross sectional shapes or other cross sectional shapes, including elliptical, ovoid, or shapes that include convex and concave regions, e.g. a kidney bean shape, and other regular and irregular shapes. The cross sectional shapes of passages the cooling jacket 200 may generally be the same or may vary at different locations within the jacket compared to one another or within an individual passage. Additionally, the passages within the jacket 200 may have an effective diameter or cross sectional area that increases or decreases in various regions of the insert, for example, as an increasing or decreasing tapered section. Changing cross sectional areas may be provided as gradual, continuous changes, and without any steps or discontinuities, to reduce or minimize flow losses in the fluid circuit.

Also note that the cooling jacket 200 may eliminate various plugs or end caps that are present in the conventional cooling jackets 100, 102 as illustrated in FIG. 2. This improves the integrity of the system 200 by reducing locations where fluid leaks are possible, and further reduces the volume of the cooling jacket, leading to a higher efficiency system. It also increases the manufacturability, as it reduces the number of steps and processes for forming a finished component such as a cylinder head.

Figure 3:
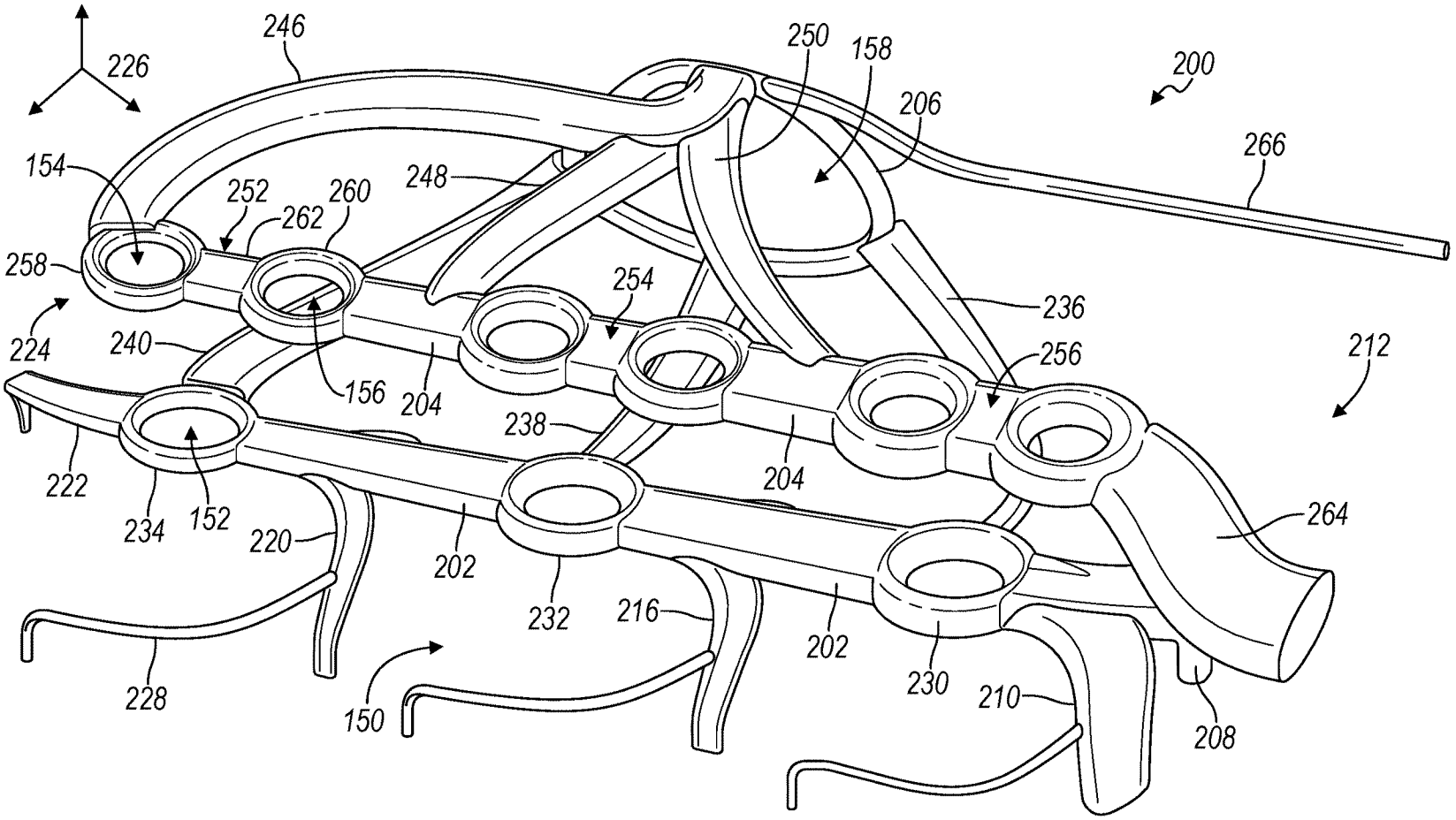
FIG. 3 illustrates a perspective view of a cooling jacket according to an embodiment.
Figure 4:
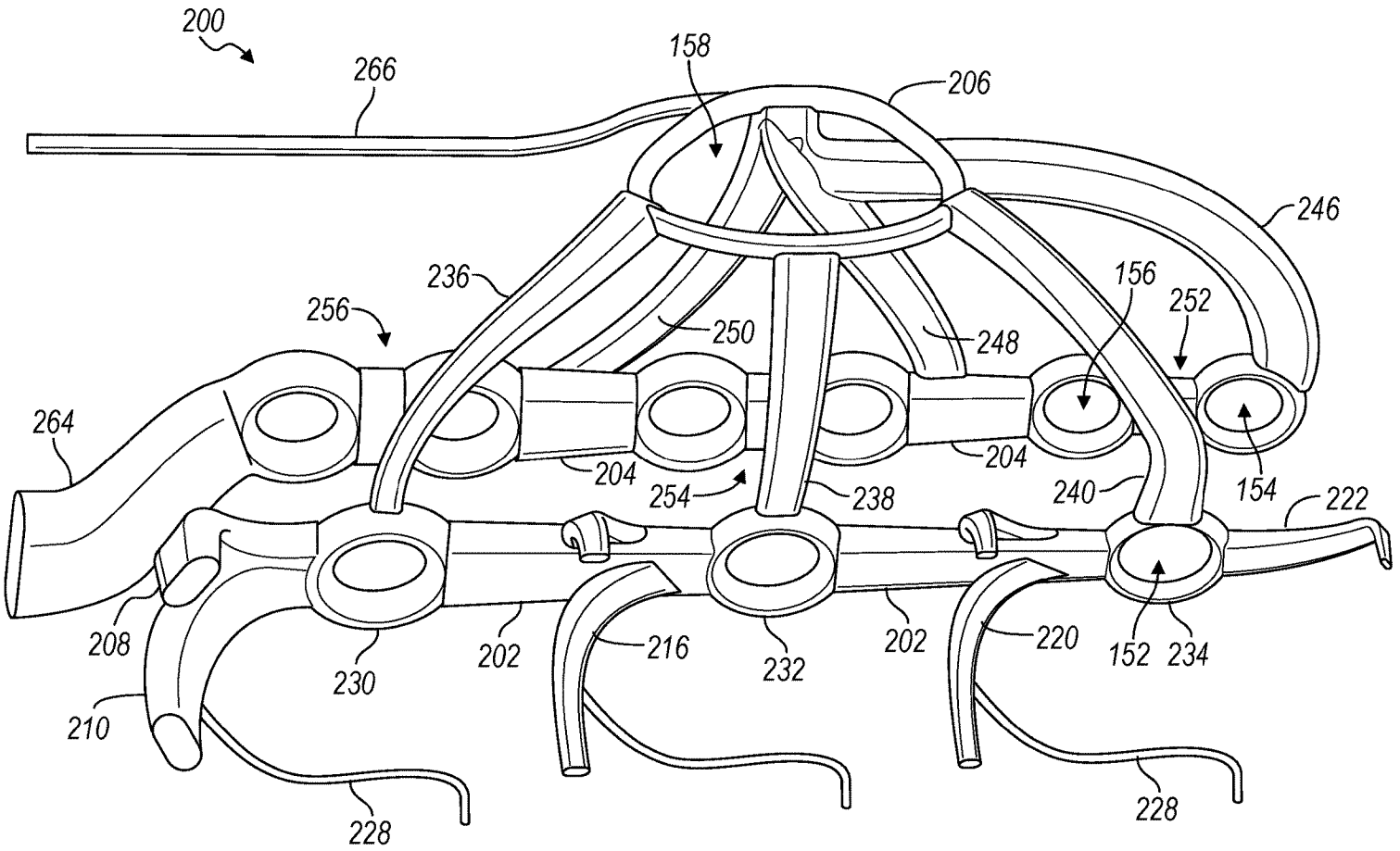
FIG. 4 illustrates another perspective view of the cooling jacket of FIG. 3.

The cooling jacket 200 has a series of interconnected fluid passages as shown in FIGS. 3-4 that direct pressurized lubricant to various regions of the cylinder head for thermal management of the cylinder head. The position, shape, and size of the passages are closely controlled based on the present disclosure to control the temperature of the cylinder head during engine operation, and provide an efficient effective cooling jacket. The cooling jacket 200 has passages with various curved shapes and structures, and smooth changes in cross sectional area and direction to provide for reduced flow losses. For example, the overall pressure losses are due to friction, which is a component with two different aspects; one is the major losses caused by an enclosed pipe with a certain length; and the other aspect is local losses which are caused by the bends in the flow path and/or sudden changes in flow area. The local losses are commonly referred to as "K Losses" and are the easier of the two losses to control and reduce an overall pressure loss for the system.

By improving the flow characteristics of the cooling jacket 200, a smaller pump 88 may be used, and the system may operate at a higher efficiency, thereby increasing the engine efficiency, fuel economy, and reducing overall engine parasitic loses. The size, e.g. the diameter of a circular passage or effective diameter for a noncircular cross sectional passage, and the length of the passages affects the pressure, flow rate, and losses within the jacket 200. Size may also refer to the cross sectional areas of the passages, which is linked to the effective diameter. Likewise, the shape of the passages, e.g. the number of turns or bends in the passages, how tight the turns are, and a change in diameter, affects the pressure, flow rate, and losses in the jacket 200. A gradual, smooth, or continuous diameter or area change in a passage results in lower flow losses than a discrete or stepwise diameter change. Similarly, a smooth, curved, bend or turn results in lower flow losses than an angled turn or bend with a corner element.

Conventional cooling jackets 100, 102 are shaped to generally give the coolant whatever is left of the cylinder head volume after the combustion requirements and component positioning requirements are met. After the cooling jackets 100, 102 have been associated with the remaining volume of the head, various localized flow and or thermal issues may be addressed using balancing and ribbing techniques or by simply increasing the volumetric flow rate of the pump, for example, by adjusting the blade shape, modifying gearing to increase pump speed, etc. Using the conventional cooling jackets 100, 102, regions of the cylinder head are "overcooled" and other regions of the cylinder head may be in need of more cooling. As engine design changes, for example, by moving to a turbocharged or boosted engine with higher boost pressures, the engine operating temperature will increase, and engine cooling demands also increase. The cooling capacity of the cooling jackets 100, 102 may act to limit the engine boost pressures or other engine design characteristics. Additionally, any inefficiencies in the cooling jackets 100, 102 may also reduce overall fuel efficiency of the engine, as the pump in the cooling system acts as a parasitic loss for the engine. Additionally, the large passages and volumes of the cooling jackets 100, 102 require a longer time to heat up and/or cool down which directly impacts emissions requirements.

The cooling jacket 200 provides for directed flow of the coolant by providing an interconnected network of cooling passages with the size of the passages varied to reduce or minimize flow losses through the jacket 200 and supply the a higher or maximized flow velocity to area of the cylinder head with a high heat load, or the critical areas, while generally areas of the cylinder head with a low operating temperature and a low heat load. The jacket 200 is provided with a network of interconnected passages that are positioned to distribute the flow in an even manner to the high priority heat flux locations first. The shapes and sizes of the passages in the jacket 200 may be varied based on the structure of the associated cylinder head, the head flux of the associated head and engine, and various manufacturing limitations. As a result the cooling jacket 200 provides colder and faster coolant to regions with higher operating temperatures, thus improving the efficiency of the jacket 200 and overall cooling system. The passages in the jacket 200 may be generally sized to have a narrow or small diameter, for example, with a length to diameter ratio of the passages being more than three, more than five, or more than ten in various examples.

The overall volume of the cooling jacket 200 is greatly decreased from the jackets 100, 102. As the passages in the jacket 200 are reduced or minimized in volume, the overall volume of the jacket 200 is reduced, and the warm-up/cooldown times for the head are also reduced.

Likewise, as the volume of the jacket 200 is smaller, the pump for the cooling system has a reduced demand, and will therefore require less power to operate and provide increased system efficiency.

The various passages of the jacket 200 are sized to provide sufficient cooling to high temperature regions of the cylinder head during engine operation. Similarly, to prevent issues such as a vapor phase change of the coolant in the passages of the jacket 200, for example, after engine or vehicle shut down, a secondary electric coolant pump 89 may be provided to circulate coolant post-shut down and prevent a phase change. The coolant pump 89 may be arranged sequentially with the pump 88 for serial flow, or may be arranged for parallel flow with the pump 88 as shown in FIG. 1.

Figure 5:
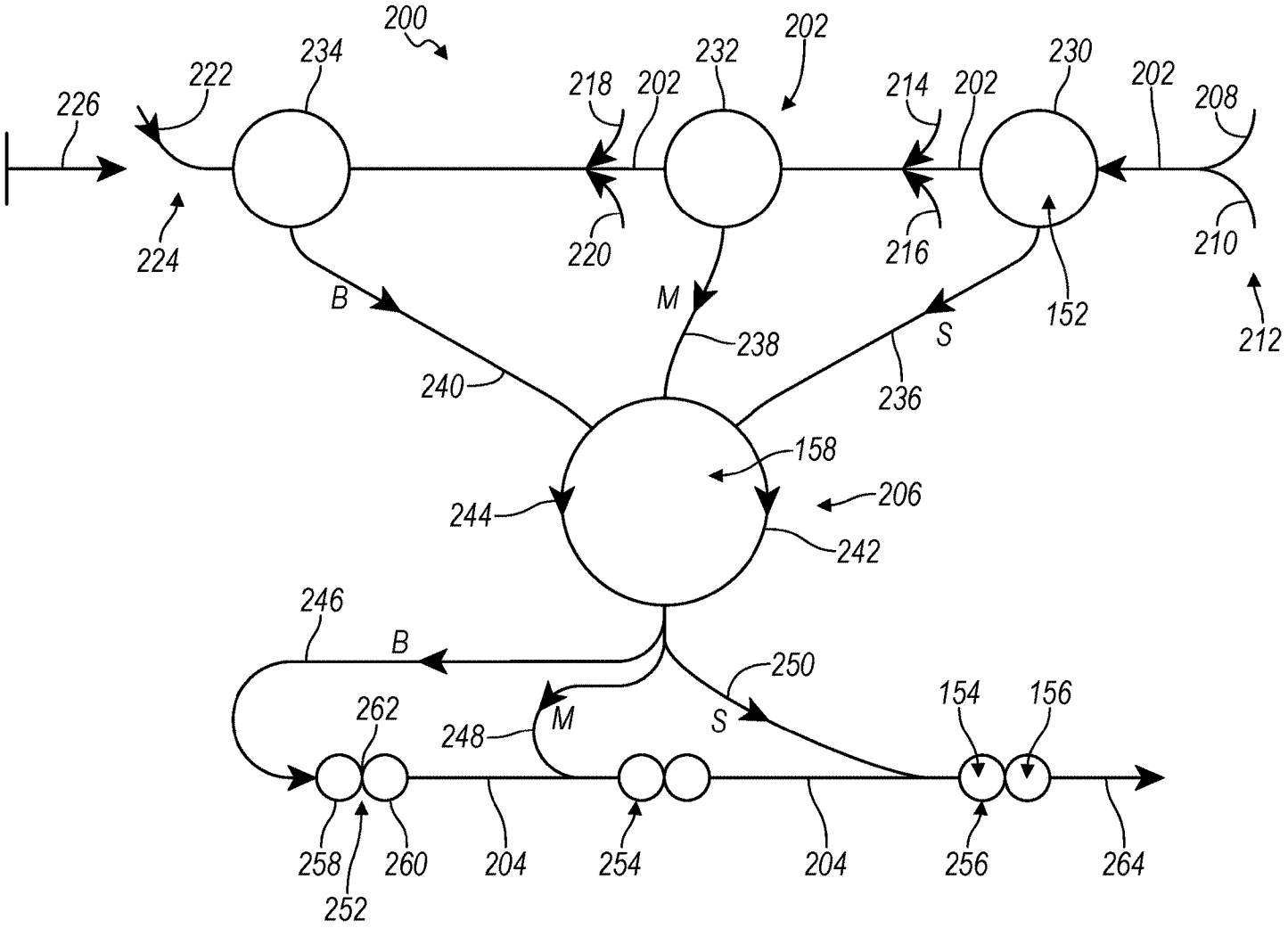
FIG. 5 illustrates a flow schematic of the cooling jacket of FIG. 3.

FIGS. 3-4 illustrate perspective view of the cooling jacket 200 according to the present disclosure and as shown in FIG. 2. FIG. 5 illustrates a schematic view of the cooling jacket of FIGS. 3-4. The "S", "M", and "B" indicate the sizes of similar elements relative to one another, with S referring to the smallest size, M referring to a medium or intermediate size, and B referring to the biggest or largest size. When more than three passages are provided in a set of similar elements, the relative size trend may remain the same, with the passages arranged largest to smallest, or vice versa, relative to one another.

The jacket 200 has a first main passage 202, and a second main passage 204. Each passage 202, 204 extends generally along or parallel to a longitudinal axis 226 of the engine. The passage 202 may be an inlet passage and is generally associated with cooling the spark plug regions 152 of the cylinder head. The passage 204 may be an outlet passage and is generally associated with cooling the exhaust valve regions 154 and exhaust valve bridges between adjacent valves in the cylinder head. The first and second passages are connected by an integrated exhaust manifold (IEM) cooling passage 206 that is associated with cooling the region 158 surrounding the IEM and the exhaust face of the head. The first passage 202 receives coolant from coolant feed passages fluidly connected to the cooling jacket 84 in the cylinder block. The second passage 204 provides coolant to a coolant outlet for the head, which in turn flows to a pump, radiator, or other component in the cooling system 80.

The inlet passage 202 receives at least one coolant feed, and in the present example, receives coolant feeds at four longitudinal locations of the engine. The block cooling jacket 84 may be provided in an open deck, semi-open deck or closed deck engine, and apertures are provided as appropriate in the block deck face and/or head gasket to provide the flow of coolant from the block to the head jacket 200. In the present example, the inlet passage 202 receives a feed of coolant via first and second feed passages 208, 210 at a first end 212 of the engine from a cooling jacket in the block. The inlet passage 202 receives another feed of coolant via third and fourth feed passages 214 216, yet another feed of coolant at fifth and sixth feed passages 218, 220, and a final seventh coolant feed 222 at the opposed end 224 of the engine, such that coolant generally flows from right to left through passage 202 in FIG. 3. Passage 222 may be larger in cross sectional area than what is shown in FIG. 3, flow through passage 222 may be restricted via use of an orifice, e.g. using the head gasket, or may not be present in the jacket 200. Flow through any of the feed passages may be restricted at the inlet to the respective feed passage via use of an orifice, e.g. an orifice in the head gasket.

In the present example, the feed passages at each longitudinal location of the head are on either side of the main longitudinal axis 226 of the engine. In other examples, only one feed passage may be provided at a longitudinal location in the engine, or more than two feeds may be provided. In the present example, the coolant in the underlying engine block cooling jacket flows from end 224 of the engine to the other end 212 of the engine. In other examples, the coolant in the underlying engine block may flow in the opposite direction, or in another flow pattern.

The cooling jacket 200 also has an inlet valve cooling passage 228 associated with each pair of inlet valves that connects to an associated feed passage. In other examples, the jacket 200 may not have inlet valve cooling passages 228. The inlet valve passage 228 is only illustrated in FIGS. 3-4 for clarity of FIG. 5. The inlet cooling passage 228 may be provided to provide a low coolant flow or relief from a region of the block jacket and may not provide a significant impact on the head jacket 200 flow. Passages 228 may have various sizes, and may be larger in cross sectional area than what is shown in FIG. 3. Alternatively, flow through passage 228 may be restricted via use of an orifice.

Each feed passage 208-222 has a smaller cross sectional area than the preceding upstream feed passage. The cross sectional area of an individual feed passage increases in cross sectional area along the length of the feed passage to provide for smooth entry and mixing of the coolant in the feed passage with the coolant in the inlet passage. The feed passages at each longitudinal location may have equivalent cross sectional areas and general shapes compared to one another, or may differ in area and/or shape. In the present example, feed passages passage 208 has a larger cross sectional area than downstream feed passage 214, which in turn has a larger cross sectional area than downstream feed passage 218, which has a larger cross sectional area than feed passage 222.

The inlet passage 202 itself continually decreases in cross sectional area along the length of the passage 202 and in the direction of coolant flow therethrough. The passage 202 incorporates annular passage regions 230, 232, 234 to provide coolant flow around a spark plug. The annular passage region may have an equivalent cross sectional area as the section of the inlet passage 202 immediately preceding the annular passage region. The present example has three annular passage regions, with decreasing cross sectional area corresponding to the decreasing cross sectional area of the overall inlet passage 202. Annular passage region 230 has a larger cross sectional area than downstream annular passage region 232, which in turn has a larger cross sectional area compared with downstream annular passage region 234.

Coolant flow leaves the inlet passage 202 at each annular passage region 230, 232, 234 through a respective lower passage 236, 238, 240 in a series of lower passages. Each lower passage 236, 238, 240 fluidly connects a respective annular passage region of the inlet passage 202 with the IEM cooling passage 206. Each lower passage 236, 238, 240 has a larger cross sectional area compared to a preceding upstream lower passage. In the present example, lower passage 236 has a smaller cross sectional area than lower passage 238, which in turn has a smaller cross sectional area than passage 240. The cross sectional area of an individual lower passage may increase along the length of the lower passage. Each lower passage may generally follow and be below an exhaust runner or passage of the engine to assist in cooling the cylinder head adjacent to the exhaust passage.

The IEM cooling passage 206 provides a passage to surround the exhaust passages adjacent to the exhaust face of the cylinder head defined as region 158. Without cooling, the exhaust face of the cylinder head may reach a high temperature during engine operation as exhaust components are connected to the face, and heat loss to the ambient environment is therefore limited.

The coolant leaves the IEM passage 206 through upper passages 246, 248, 250. The coolant flows through the IEM passage 206 from the lower passages to the upper passages via a first section 242 or a second section 244 of the IEM passage. In the present example, upper passages 246, 248, 250 join one another and merge to provide a single fluid connection to the IEM passage 206. The IEM cooling passage 206 has a cross sectional area that matches or is slightly larger than the cross sectional area of the exit of the lower passage 240, and in one example this yields a cross sectional area about half of the area depicted at the 240 exit and is a based on the IEM passage 206 being a circular shaped passage where flow may proceed through two separate paths on the circle shaped passage 206 to the three possible exits 246, 248, and 250.

Each upper passage 246, 248, 250 fluidly connects the IEM passage 206 to the second outlet passage 204 at various locations along the outlet passage 204 with respect to the longitudinal axis 226 of the engine as described below. Each upper passage 246, 248, 250 has a larger cross sectional area compared to a subsequent downstream upper passage. In the present example, upper passage 246 has a larger cross sectional area than upper passage 248, which in turn has a larger cross sectional area than passage 250. The cross sectional area of an individual upper passage may decrease along the length of the upper passage. Each upper passage may generally follow and be above an exhaust runner or passage of the engine to assist in cooling the cylinder head adjacent to the exhaust passage.

The second passage or outlet passage 204 itself continually increases in cross sectional area along the length of the passage 204 and in the direction of coolant flow therethrough. The passage 204 incorporates exhaust valve regions 252, 254, 256 for cooling the cylinder head adjacent to each pair of exhaust valves. Each exhaust valve region has a first annular region 258 and a second annular region 260 surrounding each exhaust valve for a cylinder to provide a pair of annular regions. A bridge region 262 connects the pair of annular regions 258, 260 and provides for flow of coolant directly through or across an exhaust bridge in the cylinder. Without sufficient cooling, the exhaust bridge may reach high operating temperatures based on the proximity to the exhaust region of the combustion chamber, being positioned between the two exhaust valves and ports. Exhaust valve regions 254, 256 have a similar structure compared to that described with respect to region 252.

Each exhaust valve region may have an equivalent cross sectional area as the section of the outlet passage 204 immediately preceding the exhaust valve region. The present example has three exhaust valve passage regions, with increasing cross sectional area corresponding to the increasing cross sectional area of the overall outlet passage 204. Exhaust valve region 252 has a smaller cross sectional area than downstream exhaust valve region 254, which in turn has a smaller cross sectional area compared with downstream exhaust valve region 256.

Each upper passage 246-250 may connect to the outlet passage 204 just before each of the exhaust valve regions in one example. In other examples, the upper passages may connect to the exhaust valve regions, for example an annular region, of the outlet passage.

The cooling jacket 200 has a single outlet or exit port 264 from the outlet passage 204. In other examples, the cooling jacket 200 may have more than one outlet. Passage 266 provides a degas line for the cooling jacket 200 and is generally positioned at a high point of the cooling jacket 200 in the cylinder head. Passage 266 may have various sizes, and may be larger or smaller in cross sectional area than what is shown in FIG. 3. Alternatively, flow through passage 266 may be restricted via use of an orifice, or may not be present in the jacket 200 if the jacket has an alternative degas strategy.

The coolant in the inlet and outlet passages 202, 204 flows in opposed directions, and generally longitudinally in the cylinder head and engine. In other examples, the coolant may flow in the same direction in the inlet and outlet passages 202, 204; however, the cross sectional areas of the upper passages would be generally reversed.

As can be seen in FIGS. 3-4, each passage of the jacket 200 provides a smooth curved flow path for the coolant, without flow disturbances, abrupt restrictions, or severe bends or corners, and the passages are joined at junctions or intersections that are also smooth, curved, and continuous. As such, losses in the jacket 200 are reduced and flow and cooling efficiencies are increased.

Similarly, each passage in the jacket 200 provides a continuously changing cross sectional area. The inlet passage 202 decreases in area, and the outlet passage 204 increases in area with fluid flow. Cross flow passages connecting to the inlet or outlet passage vary in cross sectional area compared to one another. A cross flow passage may be an upper passage or a lower passage in the present example. For example, the cross sectional area of a cross flow passage in a series of cross flow passages increases with a decreasing cross sectional area of the corresponding inlet or outlet passage.

Figure 6:
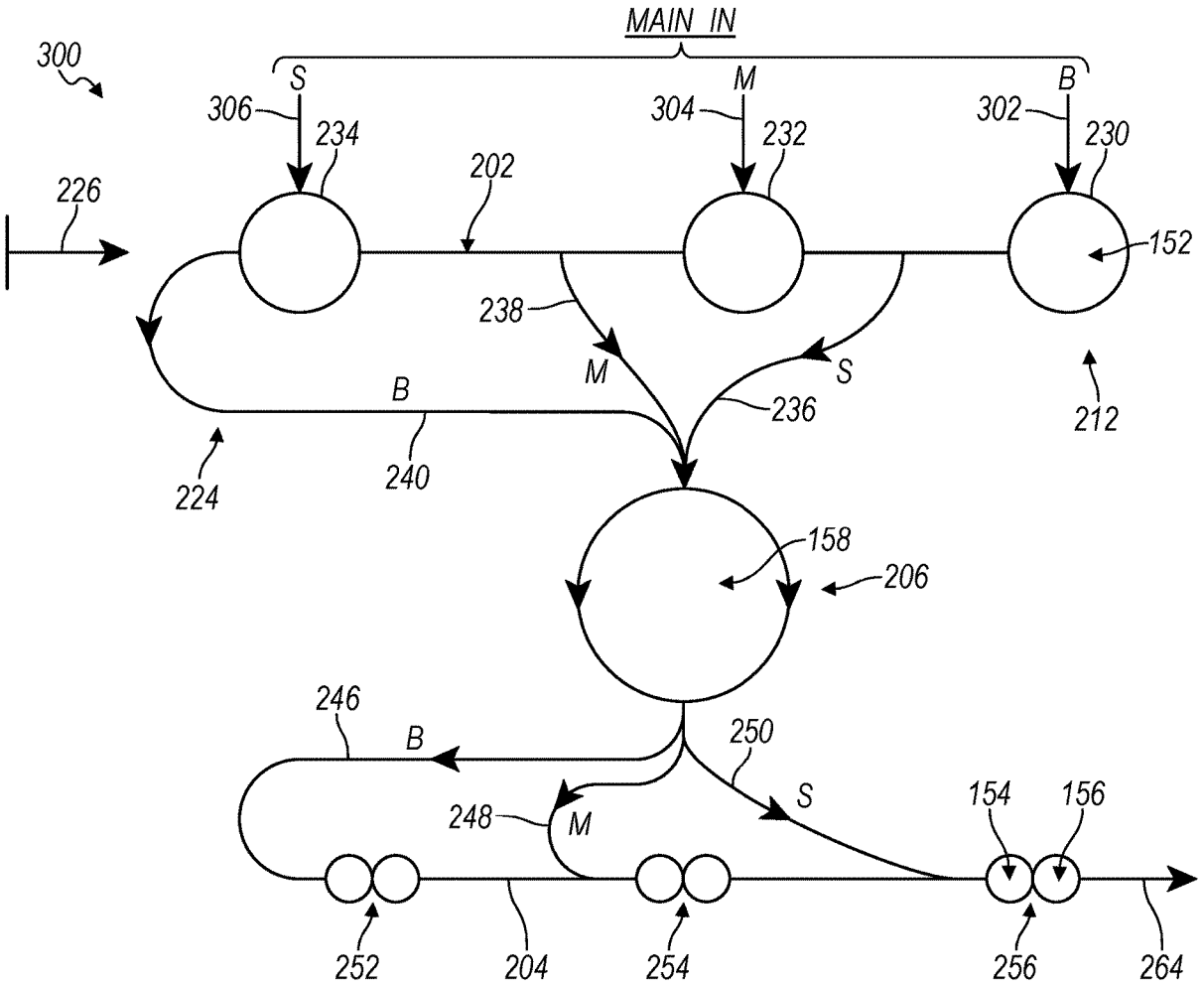
FIG. 6 illustrates a flow schematic of a cooling jacket according to another embodiment.

Another cooling jacket 300 according to the present disclosure is illustrated schematically in FIG. 6. Elements that are the same or similar to those illustrated in FIGS. 3-5 are given the same reference number. The "S", "M", and "B" indicate the sizes of similar elements relative to one another, with S referring to the smallest, M referring to the medium or middle size, and B referring to the largest. FIG. 6 promotes parallel flow paths and the overall conceptual layout is intact, e.g. it has more of a spider web aspect, which may provide for increased and improved cooling and thermal management of the head.

The first passage 204 of the jacket 300 is fed by three feed passages 302, 304, 306. Each of the three feed passages is in fluid communication with a coolant source, for example, a block jacket 84. The feed passages 302, 304, 306 each are fluidly coupled to a respective annular region 230, 232, 234 of the passage 202, opposed to upstream of an annular passage as shown in FIG. 5.

The lower series of passages 236, 238, 240 may be coupled to the first passage 202 downstream of the annular regions 230, 232, 234, and may join or merge together prior to the fluid coupling with IEM passage 206. The upper passages 246, 248, 250 and the second passage 104 with the annular exhaust valve regions 252, 254, 256 may be arranged in a similar manner as to that described above with respect to FIGS. 3-5.

Figure 7:
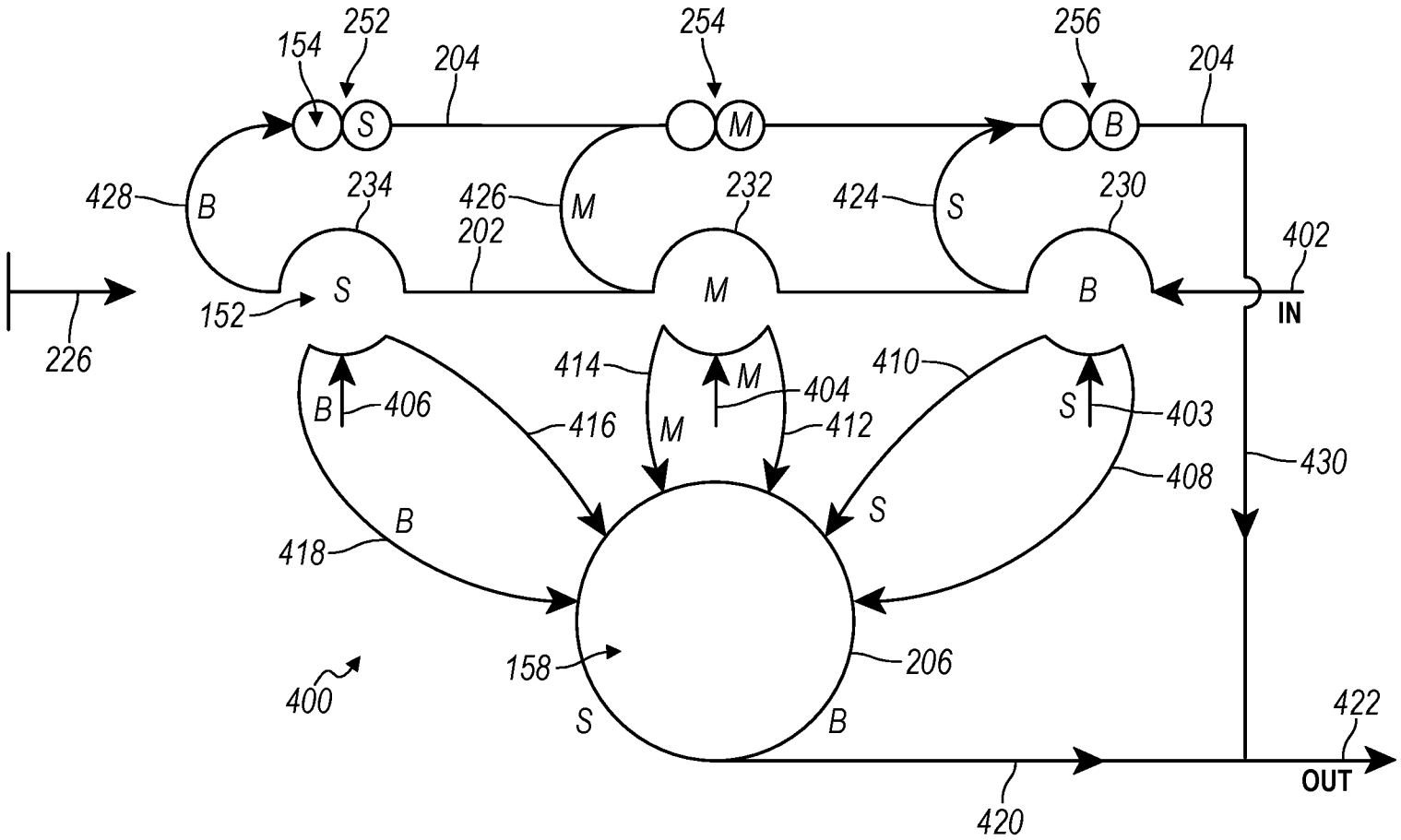
FIG. 7 illustrates a flow schematic of a cooling jacket according to yet another embodiment.

Another cooling jacket 400 according to the present disclosure is illustrated schematically in FIG. 7. Elements that are the same or similar to those illustrated in FIGS. 3-5 are given the same reference number. The "S", "M", and "B" indicate the sizes of similar elements relative to one another, with S referring to the smallest, M referring to the medium or middle size, and B referring to the largest. In FIG. 7, the exhaust valve regions 154, 156 are given a higher priority in the cooling path in the jacket compared to the earlier described jackets.

A primary feed 402 provides coolant to the first passage 202 and annular regions 230, 232, 234 surrounding the spark plugs. Each annular region of the first passage 202 may also receive a feed 403, 404, 406, for example, from a block cooling jacket. A first series of passages 408-418 fluidly couple the annular regions of the first passage 202 to the IEM passage 206, which may have a non-uniform cross-sectional area as shown. The coolant exits the IEM passage 206 through passage 420, which couples with a coolant outlet 422.

A second series of passages 424-428 fluidly couples the first passage 202 to the second passage 204. The second passage includes annular regions 252, 254, 256 for cooling of the exhaust valves. Coolant exits the fluid passage 204 via passage 430. Passage 430 merges with passage 420 prior to the coolant outlet 422. As can be seen from FIG. 7, coolant is directed first to cool the spark plug regions of the head, and then is divided in a split parallel flow configuration to direct the coolant to both the IEM region and the exhaust valve regions of the head.

Generally, the cooling jacket may be sized according to the following general principles. Of course, deviations from this may be required, for example, due to packaging constraints and the like imposed by the overall structure and other systems in the cylinder head. The inlet passage continually decreases in cross-sectional area, while the outlet passage continually increases in cross sectional area. The cross flow passages connecting the inlet and outlet passage vary in cross sectional compared to one another, with the first passage providing flow from the inlet passage to the outlet passage having a smaller cross sectional area than the last passage providing flow from the inlet passage to the outlet passage. The cross sectional area of the inlet and the outlet of the cooling jacket are generally equal to one another, or the outlet cross sectional area is larger than the inlet cross sectional area. The cross sectional area of the system at various stages in the system remains a generally constant value, as explained below.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. A cylinder head comprising:

a member defining a cooling jacket having first and second passages fluidly connected by a third passage surrounding an integrated exhaust manifold, the first passage extending longitudinally with a continuously decreasing area in a coolant flow direction and having an annular section about a spark plug, the second passage extending longitudinally with a continuously increasing area in the coolant flow direction and having an annular section about an exhaust valve.

2. The head of claim 1 wherein the cooling jacket has first and second lower passages fluidly coupling the first passage to the third passage, the first and second lower passages coupled to the first passage such that second lower passage is downstream of and longitudinally spaced apart from the first lower passage, the second lower passage having a larger area than the first lower passage.

3. The head of claim 1 wherein the cooling jacket has first and second upper passages fluidly coupling the third passage to the second passage, the first and second upper passages coupled to the second passage such that the second upper passage is downstream of and longitudinally spaced apart from the first upper passage, the second upper passage having a smaller area than the first upper passage.

4. The head of claim 1 wherein the cooling jacket has a feed passage fluidly coupling a block jacket to the first passage to provide coolant thereto.

5. The head of claim 1 wherein the cooling jacket has an outlet passage receiving coolant flow from the second passage.

6. The head of claim 1 wherein the first passage is positioned between the second passage and a deck face, wherein each of the first and second passages extend from a first end region to a second opposed end region of the member.

7. The head of claim 1 wherein the cooling jacket is formed by curved walls and without a step discontinuity.

8. An engine comprising:

a cylinder head having a deck face to mate with a corresponding face of a cylinder block, the head defining a cooling jacket therein, the cooling jacket formed from a series of passages interconnected by a series of curved junctions to direct coolant about spark plugs, exhaust valves, and an integrated exhaust manifold in the head, each passage having a length that is greater than an average effective diameter of the passage;

wherein the cooling jacket has a first passage extending along a first longitudinal axis of the head and having an annular region surrounding each spark plug, the first passage having a continuously decreasing cross-sectional area; and wherein the cooling jacket has a second passage extending along a second longitudinal axis of the head and having an annular region surrounding each exhaust valve and a bridge passage extending across each exhaust bridge of the head, the second passage having a continuously increasing cross-sectional area.

9. The engine of claim 8 wherein the cooling jacket has a third passage surrounding the integrated exhaust manifold and adjacent to an exhaust face of the head.

10. The engine of claim 9 wherein the cooling jacket has a series of lower passages fluidly coupling the first passage to the third passage and longitudinally spaced from one another, each lower passage in the series of lower passages increasing in cross-sectional area as the cross-sectional area of the first passage decreases.

11. The engine of claim 10 wherein the cooling jacket has a series of upper passages fluidly coupling the third passage to the second passage and longitudinally spaced from one another, each upper passage in the series of upper passages decreasing in cross-sectional area as the cross-sectional area of the second passage increases.

12. The engine of claim 11 wherein the interconnected passages of the cooling jacket are arranged such that coolant sequentially flows from the first passage, through the series of lower passages, through the third passage, through the series of upper passages, and to the second passage.

13. The engine of claim 9 further comprising a cylinder block defining a block cooling jacket;

wherein the cooling jacket in the head defines at least one feed passage fluidly coupling the block cooling jacket to the first passage to provide coolant thereto.

14. The engine of claim 9 further comprising an outlet port fluidly coupled to the second passage.

15. The engine of claim 8 further comprising a pumping system to drive coolant flow through the cooling jacket;

wherein the pumping system comprises one of (i) an electric coolant pump to drive coolant flow through the cooling jacket, and (ii) a first mechanical coolant pump to drive coolant flow through the cooling jacket during engine operation and a second electrical coolant pump to drive coolant flow through the cooling jacket when the engine is inoperative.

16. An engine component comprising:

a cylinder head defining a cooling jacket;

wherein the cooling jacket has a first passage extending longitudinally from a first end region to a second end region of the head and having a continuously decreasing cross-sectional area towards the second end region and in a direction of coolant flow therethrough, the first passage having a series of annular regions, each annular region surrounding a recess sized to receive a spark plug; and wherein the cooling jacket has a second passage extending longitudinally from the second end region to the first end region of the head and having a continuously increasing cross-sectional area towards the first end region and in a direction of coolant flow therethrough, the second passage receiving coolant from the first passage, the second passage having a series of pairs of annular regions, each pair of annular regions surrounding a pair of recesses sized to receive a pair of exhaust valves.

17. The engine of claim 16 wherein the cooling jacket has a series of passages fluidly connecting the first passage to the second passage to provide flow thereto, the series of passages longitudinally spaced apart from one another between the first and second ends of the head, wherein a cross sectional area of each passage in the series of passages increases towards the second end of the head.

18. The engine of claim 16 wherein the cooling jacket has a ring passage surrounding exhaust passages of an integrated exhaust manifold in the head, the ring passage adjacent to an exhaust face of the cylinder head and receiving coolant from the first passage.

19. The engine of claim 18 wherein the second passage receives coolant from the first passage via the ring passage.

* * * * *